United States Patent [19]

Bodouroglou

[11] Patent Number: 4,960,295

[45] Date of Patent: Oct. 2, 1990

[54] TWO-SHOT HOT-MELT BOOKBINDING

[75] Inventor: John Bodouroglou, Oak Park, Ill.

[73] Assignee: Eschem Inc., Downers Grove, Ill.

[21] Appl. No.: 249,910

[22] Filed: Sep. 27, 1988

[51] Int. Cl.[5] ..... B42C 9/00

[52] U.S. Cl. ..... 281/15.1; 251/21.1; 412/5

[58] Field of Search ..... 281/21.1, 15.1; 412/5

[56] References Cited

U.S. PATENT DOCUMENTS

| | | | |
|---|---|---|---|
| 3,615,106 | 10/1971 | Flanagan et al. | 281/21.1 |
| 3,837,994 | 9/1974 | Flanagan et al. | 281/21.1 X |
| 4,140,733 | 2/1979 | Meyer, Jr. et al. | 412/5 X |
| 4,345,349 | 8/1981 | Flanagan et al. | 412/5 |
| 4,371,194 | 2/1983 | Wang et al. | 281/21.1 |
| 4,371,195 | 2/1983 | Wang et al. | 281/21.1 |
| 4,408,780 | 10/1983 | Detterman et al. | 281/15.1 |
| 4,508,773 | 4/1985 | Maxwell | 428/198 |
| 4,526,642 | 7/1985 | Caughey | 156/381 X |
| 4,536,012 | 8/1985 | Hume, III | 281/21.1 |
| 4,564,649 | 1/1986 | Hume, III et al. | 524/13 |
| 4,608,111 | 8/1986 | Hume, III et al. | 156/306.6 |
| 4,660,858 | 4/1987 | Flanagan | 281/21. 1 |
| 4,702,496 | 10/1987 | Hume, III | 281/15.1 |
| 4,712,808 | 12/1987 | Beh-Fornest et al. | 281/15.1 |
| 4,722,650 | 2/1988 | Allen et al. | 412/3 |
| 4,728,688 | 3/1988 | Tizzard et al. | 524/504 |

*Primary Examiner*—Paul A. Bell

*Attorney, Agent, or Firm*—Lockwood, Alex, Fitzgibbon & Cummings

[57] ABSTRACT

Two-shot hot-melt bookbinding adhesives, books and related articles bound thereby, a method for applying such adhesives, and a system for performing the method are provided. The disclosed bookbinding developments all utilize a low viscosity primer formulation having a viscosity of between about 1100 and about 2500 cps at a temperature of about 350° F. and a cover glue formulation having a viscosity which is greater than the viscosity of the primer formulations at a temperature of about 350° F. In the preferred embodiments, the primer and cover glue formulations contain a backbone polymer which includes an ethylene-based polymer either alone or in combination with another polymer. The disclosed primer formulations are especially useful in binding books made with paper substrates that present difficult adhesion problems. The disclosed cover glue formulations are capable of penetrating, fusing and re-enforcing the primer while simultaneously adhering to a soft cover or liner substrate.

9 Claims, 2 Drawing Sheets

TWO-SHOT HOT-MELT BOOKBINDING

BACKGROUND AND BRIEF DESCRIPTION OF THE INVENTION

This invention generally relates to hot-melt bookbinding, books and related articles bound thereby, a method for applying such adhesives and a system for performing the method. More specifically, this invention relates to two-shot hot-melt bookbinding developments which utilize a low viscosity polymer-based primer adhesive and a high viscosity polymer based cover glue. The primer adhesive of the present invention is suitable for use in the binding of books made with difficult to bond paper substrates. Books manufactured with the disclosed two-shot hot-melt formulations exhibit desirable "easy open" properties while avoiding the problems of "cold cracks" and "cold flow".

As known in the art, perfect binding was originally used as a fast and inexpensive way to bind paperbacks or pocket books. Today, however, perfect binding is used to bind a wide variety of articles such as magazines, catalogs, directories, and the like. As used herein, "books" shall refer to all such bound articles. The technique of perfect binding generally requires stacking of the sheets of paper which will make up the pages of the book. The stacked pages are referred to as a "signature". Generally, a number of signatures are stacked together to form a "book block" which is held within a clamp while adhesive is applied to a prepared edge or backbone thereof. A cover sheet or strip is then contacted with the edge or backbone before the adhesive is allowed to set.

Prior two-shot adhesive methods often have employed primer coats formulated with an emulsion adhesive which will generally penetrate the backbone even when difficult paper substrates such as glossy paper, for example, are used. In such prior art two-shot systems, the primer coat is typically a low viscosity water-based vinyl acetate ethylene (VAE) emulsion with an ethylene vinyl acetate (EVA) or a styrene butadiene styrene rubber (SBS) hot-melt cover glue. When applied, the primer penetrates the backbone via capillary action and is dried in a conventional manner. The cover glue, in the form of a high temperature melt, is then applied to the primer and to the liner or soft paper cover. Books and other articles which have been bound by this method often experience delamination between the primer coat and the cover glue due to improper dying of the primer, resulting in poor adhesion of the cover glue thereto.

Other two-shot systems have included compatible hot-melt adhesives, such as EVA based adhesives, as both the primer and the cover glue. The use of such systems has been found useful in combatting the problem of delamination between the primer and the cover glue since the two hot-melt formulations are chemically compatible to thereby promote mixing between the two hot-melt coatings. With regard to EVA based hot-melt adhesives, the hot-melt primer typically has a viscosity of 3,000 to 4,000 cps at 350° F., and the cover glue typically has a viscosity significantly greater than that of the primer. Such two-shot hot-melt formulations generally promote stronger and higher quality bookbinding when compared with books which have been bound using a one-shot method, i.e. bound with a single hot-melt adhesive. However, traditional hot-melt two-shot methods have been less than satisfactory especially when used to bind difficult paper substrates. In such applications, the viscous hot-melt primer is not readily absorbed into the backbone of the book block. Therefore, two-shot polymer based adhesives have not been particularly useful in making strong books having the same easy open qualities of books bound by two-shot systems which include emulsion primers.

The present invention overcomes the above-discussed problems of the prior art by providing a two-shot hot-melt system wherein both the primer and cover glue formulations are hot-melt adhesives, wherein the primer is a low viscosity hot-melt adhesive and wherein the cover glue is a high viscosity hot-melt adhesive. Preferably, both the primer and cover glue are EVA hot-melt formulations which are chemically compatible to thereby avoid the aforementioned delamination problem. Additionally, the low viscosity hot-melt primer readily penetrates within and adheres to the backbone of the book block. In this manner, high quality paperback and hard bound books are easily and routinely manufactured even with paper substrates that present the most difficult adherence problems.

The present invention provides a two-shot hot-melt bookbinding system, books and related articles bound thereby, a method for perfect binding with the disclosed adhesives and a system for practicing the disclosed method. The formulations of the present invention include a low viscosity primer preferably having a viscosity between about 1,100 and about 2,500 cps and including between about 35 and about 45 percent by weight of EVA polymers. Other known ingredients, such as high melting point waxes, tackifiers and stabilizers are also typically included in the disclosed primer formulations. Additionally, high viscosity cover glue formulations are disclosed having a preferred viscosity between about 4,000 and about 6,000 cps and between about 40 and about 50 percent by weight of EVA polymers. The disclosed cover glue formulations may also include various additional known ingredients such as high melting point waxes, tackifiers, stabilizers, and pigments.

As discussed further below, books and related articles which are bound by the disclosed formulations can be prepared without the use of the gas heaters which are generally required to keep the hot-melt primer in molten form prior to application of the cover glue. Hence, the proper glue pot temperature and a longer hot-melt open-time allows the primer to remain molten after its application to the book block and prior to the application of the cover glue.

Accordingly, it is an object of the present invention to provide two-shot hot-melt adhesive formulations.

It is another object of the present invention to provide two-shot hot-melt adhesive formulations, including primer and cover glue formulations, which contain EVA polymers.

It is still another object of the present invention to provide two-shot hot-melt formulations based on EVA polymers and having a low viscosity primer which will penetrate a paper substrate and a high viscosity cover glue which will penetrate, fuse, and re-enforce the primer.

It is still another object of the present invention to provide two-shot hot-melt formulations based on EVA polymers and articles which are bound with such two-shot hot-melt formulations.

It is still another object of the present invention to provide a two-shot perfect binding method which utilizes the hot-melt adhesive formulations disclosed herein.

It is still another object of the present invention to provide a system for practicing a method for two-shot hot-melt bookbinding and utilizing the adhesive formulations disclosed herein.

BRIEF DESCRIPTION OF THE DRAWINGS

These and other objects and advantages of the present invention will become apparent upon consideration of the remainder of the disclosure including the detailed description of the invention and the drawings, wherein.

DETAILED DESCRIPTION OF THE INVENTION

Figure 1:
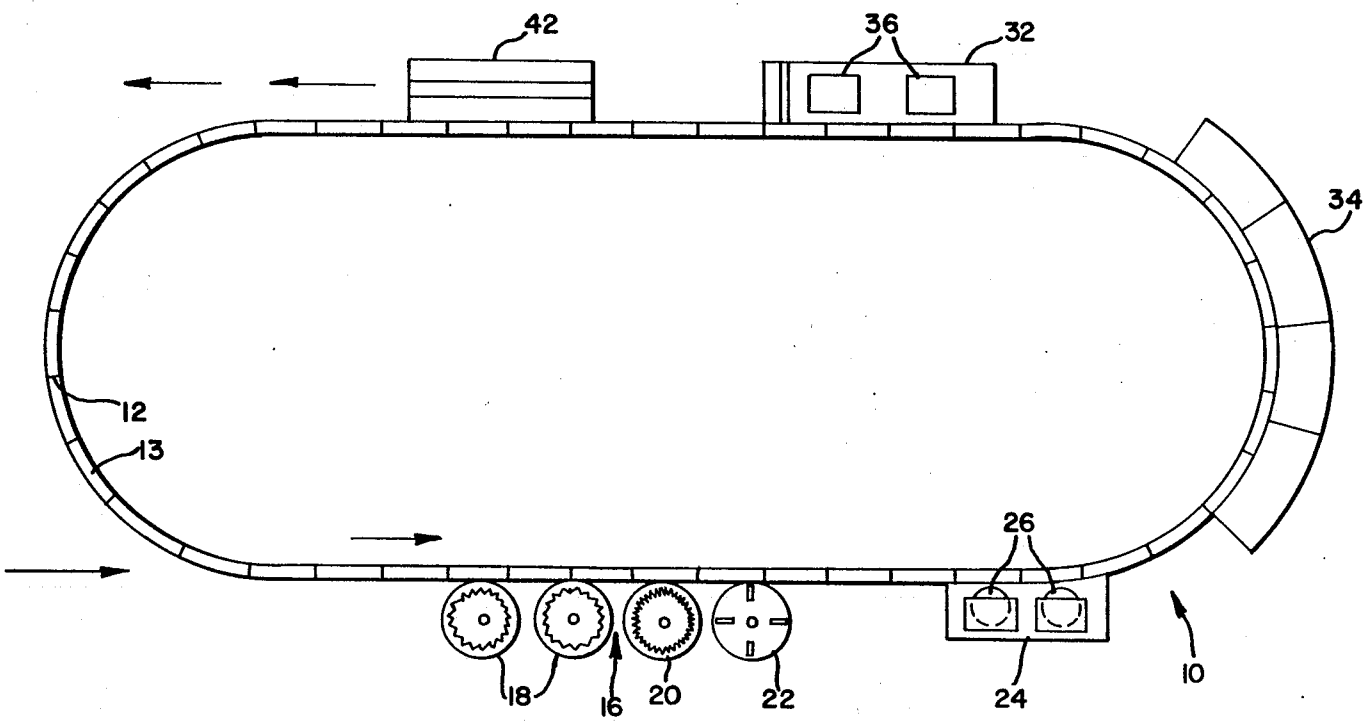
FIG. 1 is a plan view, in schematic, of a system for perfect bookbinding.

In the perfect binding of books and related articles, standard equipment is employed which generally can be used in conjunction with a variety of adhesives. For example, the overall equipment or bookbinding line utilized in two-shot bookbinding is generally the same whether a hot-melt primer or an emulsion primer is used. Referring to FIG. 1, a schematic representation of a bookbinding system 10 is given The system 10 is generally suitable for use with the two-shot hot-melt adhesives of the present invention. However, as will be explained, use of the adhesives of the present invention, in conjunction with bookbinding system 10, offer certain operational and economic advantages when compared with prior art adhesives.

Figure 2:
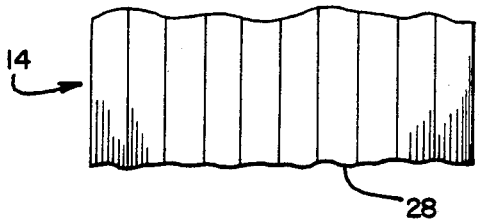
FIG. 2 is an elevational view, partly in section, of a typical book block.

The page materials are printed in long continuous webs which are cut and folded into stacks or signatures and placed in proper sequence at a gathering station (not shown). The collated signatures which form the body of the book are then clamped together within book clamps 12 positioned on a conveyor 13. The gathered and clamped signatures form a book block 14 (FIG. 2) which is typically conveyed by a conveyor 13 to a backbone preparation station 16 where saws 18, a rougher/raker 20 and a notcher/slitter 22 further prepare the sheets for application of the adhesives. The saws 18 cut the free edges of the clamped sheets to remove the folds from the signatures. The rougher/raker 20 and notcher/slitter 22 rough the backbone or spine of the book to expose a maximum amount of paper fibers. In this manner, the adhesives will be better able to penetrate the paper fibers to form an effective bond. Referring now to FIG. 2, illustration is made of a book block 14 having its backbone or spine 28 prepared in the manner described above.

From the backbone preparation station 16, the clamped pages are conveyed to a hot-melt primer pot 24 for application of primer adhesives by dual glue wheels 26. As will be appreciated by those skilled in the art, the wheels 26 generally rotate in mutually opposite directions and apply a measured amount of pressure when applying the primer to the backbone of the book block 14.

Figure 3:
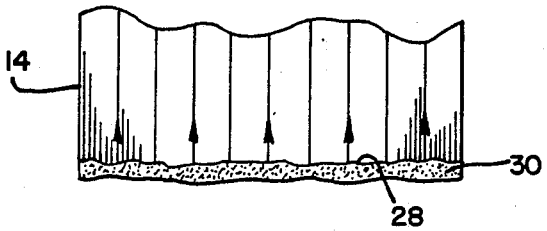
FIG. 3 is an elevational view, partly in section, of the book block of FIG. 2 and showing a layer of hot-melt primer on the backbone thereof.

Referring now to FIG. 3, the book block 14 is shown following the application of primer adhesive 30. The primer adhesive of the present invention is preferably applied at a temperature of between about 310° and about 360° F. to give a primer layer 30 having a thickness of between about 8 to about 12 mil. As discussed in more detail below, the adhesive formulations of the present invention will be of a relatively low viscosity. As such, the primer layer 30 will partially diffuse into the prepared spine 28 of the book block 14 (as indicated by the arrows in FIG. 3).

Following application of the primer, the book block is conveyed to the hot-melt cover glue pot 32. It should be noted, however, that a typical bookbinding system 10 will generally include gas dryers 34 which are required for bookbinding with various prior art primer adhesives in order to either keep the hot-melt primer in its molten state or to dry the emulsion primer prior to the application of the cover glue. As is discussed below, the primer formulations of the present invention will remain molten prior to the application of the cover glue without the application of heat and, therefore, do not require use of the gas dryers 34. Hence, bookbinding with adhesive formulations of the present invention may be more economical since the gas dryers 34 need not be run during operation of the system 10.

Figure 4:
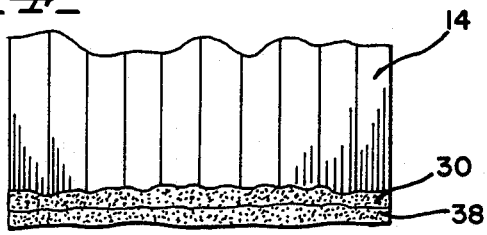
FIG. 4 is an elevational view of the book block of FIG. 3 and showing a layer of hot-melt cover glue applied on the hot-melt primer.
Figure 5:
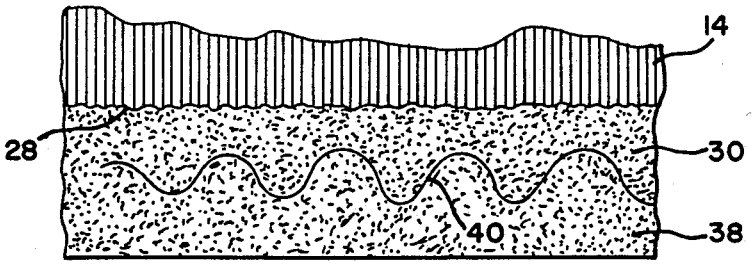
FIG. 5 is a representation of an enlarged elevational view of the junction between the hot-melt primer and the cover glue, according to the present invention.

The cover glue may be applied by two glue wheels 36 which are preferably rotating on their respective axes in the same rotational direction. Referring to FIGS. 4 and 5, illustration is made of the cover glue layer 38 following its application on top of the primer layer 30. As indicated by the uneven and intermingled border 40 in FIG. 5, the cover glue and primer will partially mix by interpenetration of the viscous cover glue layer 38 into the primer layer 30. In this manner, the cover glue penetrates and re-enforces the primer while simultaneously adhering to a soft cover or to a liner substrate. Preferably, the cover is applied at a temperature of between about 335° and about 365° F. to give a cover glue layer of about 12 to about 15 mils. The cover glue layer 38 will have a medium to short open time, thereby permitting the cover or liner substrate to be applied immediately to the spine of the book block, such as at cover breaker 42.

Referring now to the formulations, adhesives made in accordance with the present invention include a primer and a cover glue which, most preferably, are both based on EVA polymers. Tackifiers, stabilizers, and waxes are included in both the primer and cover glue formulations. A small amount of titanium dioxide or other pigment or the like may also be added to enhance the color of the cover glue and/or the primer. Unless otherwise noted, all percentages specified herein are by weight, and are based on the total weight of the particular composition.

The primer composition is formulated to have a viscosity of, preferably, between about 1,100 and about 2,500 cps at a temperature of about 350° F. The preferred formulation of primer, having the desired viscosity, should contain between about 10 and about 20 percent by weight of a suitable high melting point wax, between about 25 to about 50 percent by weight of a combination of tackifying resins, between about 35 to about 45 percent by weight of suitable backbone polymers, and between about 0.1 to about 0.5 percent by weight of stabilizer. As is explained further herein, the preferred blend of components yields a primer which can be utilized in binding a very wide variety of paper substrates, even those which are the most difficult to bond together or to other dissimilar substrates.

The cover glue composition is substantially more viscous than the primer and is chemically similar thereto to enable the cover glue to penetrate, fuse and re-enforce the primer and to adhere to a soft cover or liner substrate. Typically, the cover glue will include between about 15 to about 25 percent by weight of a suitable wax, between about 20 to about 45 percent by weight of at least one tackifying resin, between about 40 to about 50 percent by weight of backbone polymers, less than about 5 percent by weight of a coloring agent such as titanium dioxide pigment and between about 0.1 to about 0.5 percent by weight of stabilizer. The preferred blend of components will produce a cover glue adhesive having a viscosity greater than the viscosity of the primer formulation and preferably between about 4,000 and about 6,000 cps at a temperature of about 350° F.

Additionally, it has been found that primer adhesives made according to the disclosed formulations will typically have an "open time", i.e. the time required for the resin to set, which is longer than prior art hot-melt adhesives, particularly those formulated as primer adhesives. Accordingly, as mentioned above, the primer will remain molten for a sufficiently long period of time so that the hot-melt cover glue can be applied thereto without the need for an additional external heat source to keep the primer in its molten state. In this manner, a more economical technique for perfect binding is provided wherein the molten primer and cover glue will fuse together without the added operating cost associated with conventional gas heaters, or their equivalent. The most preferred primer composition will generally be a low viscosity hot-melt having a long open-time, good flexibility and strength and excellent performance on most paper substrates.

In the preferred formulation for the cover glue, a moderately slow setting, medium open time, high viscosity bookbinding hot-melt adhesive is provided. In its preferred form, the cover glue is designed to provide excellent cold crack, flexibility and elongation especially for adhesive bound, rounded and backed, case bound books. The flexible cover glue provides good "lay flat" properties. Typically, the cover glue will be a high viscosity hot-melt having a medium to short open-time, and a white color due to the addition of a small amount of pigment.

Suitable backbone polymers for the hot-melt primer may include various polymers which are commercially available and which are known to those skilled in the art. Such backbone polymers may include ethylene-based polymers such as EVA polymers (including EVA acid terpolymers), ethylene ethyl acrylate, and ethylene acrylic acid. Additionally, the backbone polymer may include a primary component and a secondary component selected from the above materials. Where primary and secondary components are included, the primary component should preferably make up between about 25 and about 35% by weight and the secondary component should make up between about 5 and about 15% by weight of the total primer formulation.

Regarding the cover glue, the backbone polymers may include EVA polymers, EVA acid terpolymers, ethylene ethyl acrylate, ABA block copolymer and AB multiblock or radical block polymers. As in the primer, the cover glue backbone polymers may also include primary components and secondary components. Generally, the primary component should include EVA polymers, ABA block copolymers or AB multiblock polymers making up between about 20 and about 30% by weight of the total cover glue formulation. A secondary component, selected from the above-listed group, may be included to make up between about 10 and about 20 percent by weight of the cover glue formulations.

Preferably, the backbone polymers for both the primer and the cover glue will be one or more EVA polymers. EVA polymers suitable for inclusion in the primer or the cover glue formulations include conventional commercially available EVA polymers. Preferably, the EVA polymers will have about between 5 and about 40 percent vinyl acetate (VA), most preferably between about 18 and about 30% VA. The preferred EVA polymer will have a melt index of 300 to 400, as determined by standardized methods (ASTM D 1238-70). Particularly suitable commercial EVA polymers include those identified by the trade designation ELVAX. In the primer formulation, the EVA content will preferably be between about 35 to about 45 percent by weight. In the cover glue, the EVA polymer content will preferably be between about 40 to about 50 percent by weight.

The tackifying components of both the primer and cover glue compositions of the present invention generally include any suitable resin or a mixture of resins which are conventional for inclusion in hot-melt adhesives for perfect bookbinding. The tackifiers are generally selected to achieve a desired specific adhesion, a desired wetting of substrates, tack and certain cost considerations. As is known, tackifying resins include low molecular weight, low viscosity products and may be either natural or synthetic materials which supplement the flexibility, toughness and adhesive properties of the EVA backbone polymer The resin or resin mixture should be selected to be compatible with the backbone polymer as well as the other components of the adhesive composition. In this respect, suitable tackifying resins may include aromatic hydrocarbons, aromatic-/aliphatic hydrocarbons, dimerized rosin, pentaerythritol esters of rosin, hydrogenated pentaerythritol rosin esters, styrenated terpenes, rosin acids, styrene based resins, polyterpenes, phenolic modified terpenes, aliphatic hydrocarbons, styrene-modified hydrocarbons and the like.

In the primer formulation, the tackifying resins will most preferably include those which show a good affinity for paper substrates which will also combine to give good wetting characteristics, heat resistance and adhesive strength. Preferably, a combination of two or more resins are included in the primer formulation. Most preferably, the tackifying resins incorporated into the primer formulation may include a compatible aromatic-/aliphatic hydrocarbon resin, glycerol ester of rosin, a phenolic modified terpene resin and a styrenated terpene resin. Most preferably still, the primer resins will include between about 3 and about 15% by weight of a phenol modified terpene resin, between about 5 and about 25% by weight of a glycerol ester, and between about 15 and about 30% by weight of a styrenated terpene or a hydrocarbon resin. In the cover glue, the tackifying resins utilized therein will include pentaerythritol rosin, an aromatic hydrocarbon resin, glycerol ester of rosin, styrenated terpene or a compatible aromatic/aliphatic hydrocarbon resin.

The primer and cover glue formulations may also contain components such as diluents or modifiers in the form of various waxes. As will be understood by those skilled in the art, the inclusion of waxes in the formulations reduces viscosity, enhances hot-melt processing, influences the open time of the particular adhesive formulation and regulates the heat resistance of the bound book. Waxes which are suitable for inclusion in hot-melt formulations include oxidized waxes, oxidized polyethylene, high melting point microcrystalline waxes, 150° to 160° F. paraffins, synthetic waxes, and the like. Wax modifiers or low molecular weight polymers may also be added in small percentages.

In both the cover glue and primer formulations of the present invention, the waxes included therein are most preferably high melting point microcrystalline and/or synthetic waxes. The primer will preferably contain between about 10 and about 20 percent by weight and, most preferably, between about 14 and about 16 percent by weight of suitable waxes. The cover glue will preferably contain between about 15 and about 25 percent by weight and most preferably, between about 18 and about 22 percent by weight of suitable waxes.

The hot-melt compositions of the present invention will generally contain a small percentage of stabilizer. In this regard, conventional antioxidants, such as butylated hydroxy toluene (BHT) as well as other known stabilizers may be used. Both the primer and the cover glue preferably will contain between about 0.1 and about 0.5 percent by weight of stabilizer.

It may also be desirable to include other components, such a coloring agent, in the cover glue adhesive. A particularly suitable coloring agent for use in the present invention would include titanium dioxide. Preferably, the cover glue will contain between 2 to 4 percent by weight of titanium dioxide pigment and, most preferably, between 4.5 and 6.5 percent by weight.

The following specific examples will more precisely illustrate the invention and teach the procedures for practicing the invention, as well as the improvements and advantages realized thereby.

EXAMPLE 1

Various hot-melt adhesive formulations were prepared in a conventional manner and in accordance with the present invention. A single primer formulation (Formula A) and two cover glue formulations (Formulas B and C) were prepared.

The hot-melt primer of Formula A was prepared with 40%, by weight, of EVA polymers having a vinyl acetate content of 28% by weight, 45% by weight of tackifying resins. The tackifying resins included 20% by weight of compatible aromatic/aliphatic hydrocarbon resins, 20% by weight of glycerol ester of rosin, and 5% of a phenolic modified terpene resin, based on the total weight of the primer. Additionally, 14.8% by weight of a high melting point microcrystalline wax and an antioxidant in the amount of 0.2 percent by weight were added to the primer.

Cover glue Formula B was prepared with 47.5% EVA polymers having a vinyl acetate content of 28% by weight, 23.7% by weight of tackifying resins, 19% by weight of microcrystalline waxes, 4.7% synthetic waxes, stabilizers in the amount of 0.3 percent and 4.8% percent of titanium dioxide pigment.

A second cover glue formulation, Formula C, was blended to contain 46.3% by weight of EVA polymers having a vinyl acetate content of 28% by weight, tackifying resins in the amount of 23.8% by weight, 19% by weight of microcrystalline waxes, 4.7% of synthetic waxes, 6% by weight of titanium dioxide pigment and approximately 0.2 percent of an antioxidant.

Performance

On three sets of books bound with primer Formula A and cover glue Formula B, pull and flex tests were performed. The page pull procedure described herein measured the force necessary to pull a page from a book which wa bound with Formulas A and B. Four pages were selected near the beginning, middle, and the end of the book. Each book was held in place while a vacuum air valve was used to pull the tested pages up and out of the book. The pounds of force required to pull the tested pages out of the book were recorded. In general, the results of the pull procedures for the books tested which were bound by the formulations of the present invention, showed good pull resistance.

Page flex testing was performed by flexing a page in a book bound with the disclosed adhesive formulations. Each page was flexed while pulling up with a known weight until the binding failed. In this procedure, four pages were generally selected for testing near the beginning, middle, and end of the book. The book was clamped in place and the page was placed between rollers and attached to a two pound weight. The machine was capable of flexing the page at a preset value of 60 cycles per minute and would run until either the page was pulled from the book or the flex counter passed 500. Both the pull and the flex procedures were performed on standard commercial equipment (J. E. Plunkett page pull tester and J. E. Plunkett flex tester).

Two sets of test books were bound on a commercial binding system using the above-discussed Formula A primer and the Formula B cover glue. Book Set 1 was bound with the maximum pressure on the glue wheel and the backbone preparation showed some notching with good fiber exposure. Book Set 2 showed backbone preparation having deeper notching than that of Book Set 1 with comparably good fiber exposure.

Pull/Flex Test results are as follows:

TABLE 1

| Pull/Flex Testing Of Book Set 1 | | | | | |
|---|---|---|---|---|---|
| Book Number | | 1 | 2 | 3 | 4 |
| Pull Test Run (in lbs.) | 1 | 73 | 72 | | |
| | 2 | 69 | 70 | | |
| | 3 | 72 | 72 | | |
| | 4 | 73 | 76 | | |
| Average | | 71.8 | 72.5 | | |
| Flex Test Run (in no. of flexes) | 1 | | | >500 | >500 |
| | 2 | | | >500 | >500 |
| | 3 | | | >500 | 460 |
| | 4 | | | >500 | >500 |

TABLE 2

| Pull/Flex Testing Of Book Set 2 | | | | | |
|---|---|---|---|---|---|
| Book Number | | 1 | 2 | 3 | 4 |
| Pull Test Run (in lbs.) | 1 | 75 | 69 | | |
| | 2 | 72 | 76* | | |
| | 3 | 74 | 75 | | |
| | 4 | 75 | 78 | | |
| Average | | 74 | 74.5 | | |
| Flex Test Run (in no. of | 1 | | | >500 | >500 |
| | 2 | | | 373 | 303 |

TABLE 2-continued

| Book Number | | Pull/Flex Testing Of Book Set 2 1 | 2 | 3 | 4 |
|---|---|---|---|---|---|
| flexes) | 3 | | | 442 | 371 |
| | 4 | | | >500 | 7500 |

*paper tear during test

A third book set was bound on a commercial binding system. Again, Formula A and Formula B were used as the primer and cover glue formulations, respectively. In general, Book Set 3 gave lower pull and flex test values than those for Book Set 1 or Book Set 2. Backbone preparation for Book Set 3 was not as good as for Book Sets 1 and 2 with Book Set 3 showing fiber dust in the spines of the individual books. Results, however, do indicate that the bindings for these books were strong.

TABLE 3

| Book Number | | Pull/Flex Testing Of Book Set 3 1 | 2 | 3 | 4 |
|---|---|---|---|---|---|
| Pull Test Run | 1 | 56 | 52 | 42 | 46 |
| (in lbs.) | 2 | 47 | 60 | 53 | 56 |
| | 3 | 40 | 44 | 48 | 45 |
| | 4 | 39 | 44 | 52 | 42 |
| Average | | 45.5 | 50 | 48.75 | 47.25 |
| Flex Test Run | 1 | >500 | >500 | 395 | >500 |
| (in no. of | 2 | 195 | 278 | >500 | 149 |
| flexes) | 3 | >500 | >500 | 413 | 197 |
| | 4 | 151 | >500 | >500 | >500 |
| | 5 | 7500 | >500 | >500 | >500 |

EXAMPLE 2

Three primer formulations (D, E and F) were prepared as follows:

Formula D was blended with 43% by weight of EVA polymer, 13% by weight of microcrystalline wax, 0.2% by weight of stabilizer and 43.8% by weight of suitable tackifying resins Formula E was blended with 45% by weight of EVA polymer, 13% by weight of microcrystalline wax, 0.2% by weight of stabilizer and 41.8% by weight of tackifying resins.

Formula F was blended with 43% by weight of EVA polymer, 13% by weight of microcrystalline wax, 0.2% by weight of stabilizer and about 43.8% by weight of tackifying resins.

Formulas D, E and F were blended with 10% by weight of a phenolic modified terpene resin (Nirez V2040), 20% by weight of a styrenated terpene resin (Nirez M105) and between about 11.5% and about 14% by weight of a glycerol ester of rosin (Unitac R85L). Additionally, Formulas D, E and F included two different EVA polymers which had vinyl acetate contents of 28% and 18%, respectively. Formula D contained 30% EVA having a VA content of 28% and 13% EVA having a VA content of 18%. Formula E had 35% EVA having 28% VA and 10% EVA having 18% VA. Formula F had 35% of EVA having 28% VA and 8% EVA having 18% VA. All three of the Formulas D, E and F were light yellow in color.

EXAMPLE 3

Three primer formulations were prepared by slight variations of the formulations given in Example 2. Various physical properties of these primers were measured and are tabulated below. The three primer formulas (G, H and I) were blended to contain 43% by weight of EVA polymers, 14% by weight of waxes and 0.2% by weight of stabilizer, based on the total weight of the formula.

Additionally, Formula G contained about 42% by weight of tackifying resins wherein 13.8% by weight of Formula G was a phenolic modified terpene resin (Nirez V2040), 20% by weight was a styrenated terpene resin (Nirez M105), and 9% by weight was a glycerol ester of rosin (Westrez 2080).

Formula H contained about 42.8% by weight of tackifying resins wherein 13.8% by weight of Formula H was a phenolic modified terpene resin (Nirez 2040), 20% by weight was a styrenated terpene resin (Nirez M105), and 9% by weight was a glycerol ester of rosin (Westrez 2090).

Formula I was blended identically to Formula G, but it contained 21% Nirez M105 and 8% Westrez 2080.

Viscosity was determined in centipoise on a Brookfield Termosel System at 350° F. Open time was determined by laying ½ inch wide strips of paper at 5 second intervals onto a 2 inch × 20 mil drawdown. Cold crack was determined by flexing ¾ inch × 5 inch × 20 mil strips at various temperatures in a freezer. Tensile strengths and elongation were determined using 40 mil "dog bone" on a dynamometer (Instron). The 2% Secant Modulus was determined with a 40 mil "dog bone" on a dynamometer (Instron). The heat resistance (peel and shear) was determined using a 1 inch × 1 inch × 20 mil bond on paper under a 100 gram load.

TABLE 4

Physical Properties of Formulas G, H, And I

| Primer Formula | Viscosity (350° F.) | Appear. (350° F.) | 20 mil Film Melting Point (°C.) | Tensile (Yield PSI) | Tensile (Ultimate PSI) | 2% Secant Modulus (PSI) |
|---|---|---|---|---|---|---|
| G | 1637 cps | Clear | 51 | 428 | 538 | 5500 |
| H | 1675 | Clear | 52 | 466 | 562 | 5500 |
| I | 1662 | Clear | 52 | 473 | 590 | 5350 |

| Primer Formula | Elongation Percent | Cold Crack (°F.) | Heat Resistance (Peel °F.) | Heat Resistance (Shear °F.) | Static Pull (120° F.) | Impact Resistance |
|---|---|---|---|---|---|---|
| G | 527 | — | 128 | 175 | 42 | Fair |
| H | 488 | 17 | 128 | 175 | 43 | Fair |
| I | 527 | — | 128 | 175 | 42 | Fair |

Adhesion evaluations were made for Formulas G, H and I, as well as primer Formula A of Example 1. Results are listed in Table 5, below. Adhesion was determined by a qualitative evaluation using a 1/6 inch wide primer bead applied to the paper at 350° F. Evaluations were made after cooling.

The adhesion was rated on a scale from 1 to 3 where "1" indicates excellent adhesion and "3" indicates poor adhesion. A "1+" rating indicates a good adhesion.

Various types of paper were used in the adhesion evaluations. All of the paper substrates used were non-porous and inked. The particular substrates were chosen as being "difficult" to bind with typical bookbinding adhesives.

TABLE 5

| | Adhesion For Formulas G, H, And I | | | | | | | |
|---|---|---|---|---|---|---|---|---|
| Primer Formula | Phoenix Printing | Promega | House and Garden | Legend | Basic Managerial Finance | Omega Electronics | National Geo. Champion | National Geo. Westraco |
| A | 1+ | 1 | 1 | 1 | 2 | 1+ | 1+ | 2 |
| G | 1+ | 1 | 1 | 1 | 2 | 1+ | 1+ | 2 |
| H | 1+ | 1 | 1 | 1 | 2 | 1+ | 1+ | 2 |
| I | 1+ | 1 | 1 | 1 | 2 | 1+ | 1+ | 2 |

EXAMPLE 4

Six primer formulations (J-0) were prepared. The EVA polymers used in these six formulations included EVA having both 28% VA (Elvax 210) as well as 18% VA, respectively (Elvax 410). All of the formulations included 0.2% by weight of a stabilizer.

Formula J was blended to include 44% by weight of EVA polymers (32% Elvax 210 and 12% Elvax 410), tackifying resins including 13.8% by weight of a phenolic modified terpene resin (Nirez V2040), 20% by weight of a styrenated terpene resin (Nirez M105) and 8% by weight of a glycerol ester of rosin (Westrez 2080), 12% by weight of a microcrystalline wax and 2% by weight of a low molecular weight polymer or wax modifier in the form of ethyl acetate acid polymer (AC 540).

Formula K was blended to contain 44% by weight of EVA polymer (32% Elvax 210 and 12% Elvax 410), tackifying resins including 13.8% Nirez V2040, 20% Nirez M105, and 8% Westrez 2080. Additionally, 12% by weight of a microcrystalline wax was added to the formula along with 2% of a low molecular polymer/-wax modifier in the form of a polyethylene copolymer (AC8).

Formula L was blended to contain 44% by weight of EVA polymers (30% Elvax 210 and 14% Elvax 410), tackifying resins including 13% by weight Nirez V2040, 21.8% Nirez M105 and 8% of Westrez 2080. Additionally, 13% microcrystalline wax was added to the formula. No additional wax modifiers were added to this formulation.

Formula M was formulated to include 41% by weight of EVA polymers (33% Elvax 210 and 8% Elvax 410), tackifying resins including 10% by weight Nirez V2040, 25.8% by weight Nirez M105, and 8% by weight Westrez 2080. Additionally 15% by weight of a microcrystalline wax was added.

Formula N was blended to contain 44% by weight of EVA polymers (32% Elvax 210 and 12% Elvax 410), tackifying resins including 13.8% Nirez V2040, 20% Nirez M105, and 8% by weight Westrez 2080. Additionally, 12% by weight of a microcrystalline wax was added along with 2% by weight of a wax modifier in the form of a high density oxidized copolymer (AC392).

Formula O was blended to contain 44% by weight of EVA polymers (32% Elvax 210 and 12% Elvax 410), tackifying resins including 13.8% Nirez V2040, 20% Nirez M105, and 8% by weight Westrez 2080. Additionally, 12% by weight of a microcrystalline wax was added along with 2% by weight of a wax modifier in the form of ethylene vinyl acetate copolymer (AC405T).

EXAMPLE 5

Three cover glue formulations (P, Q and R) are prepared as follows:

Formula P is prepared to contain 24.7% by weight of 150° F. paraffin wax, 38.6% by weight of a styrenated terpene resin, 0.1% by weight of an antioxidant, 3% by weight of an EVA polymer (Elvax 240), 8% by weight of an ABA type polymer (Kraton 1117), and 24.7% by weight of an AB multiblock polymer (Stereon 848).

Formula Q is prepared with 27% by weight of 150° to 160° F. paraffin wax, 20.6% by weight of glyercol ester of rosin (Sylvatac 100 NS), 16% by weight of an aromatic hydrocarbon resin (Nevex 100), 35% by weight of an AB multiblock copolymer (Stereon 848) and 1.4% of an antioxidant.

Formula R is formulated to contain 24% by weight of a 150° F. paraffin wax, 30% by weight of an aromatic-/aliphatic hydrocarbon resin, 8% by weight of a pentaerythritol rosin, 5% by weight of styrene based resin, 32% by weight of an ABA block copolymer (Kraton 1102), and 1% by weight of an antioxidant.

A small percentage of additional components such as titanium dioxide pigment, for example, may also be included in the above formulations. Such formulations will include between about 2 and about 4% by weight of a suitable pigment. As mentioned herein, the pigment will provide a substantially white cover glue. The above formulations will be compatible with the ethylene based primer formulations disclosed herein.

While various embodiments have been disclosed and described herein, it will be appreciated that various changes and modifications can be made by those skilled in the art without departing from the true spirit and scope of the invention, as defined in the following claims.

What is claimed is:

1. A perfect bound book bound by two-shot hot-melt bookbinding formulations, comprising: a plurality of sheets forming a book block, said book block having a backbone of a set adhesive system which includes a layer of a hot-melt primer formulation adhered to a spine end of said sheets and a hot-melt cover glue formulation over said primer formulation;

said hot-melt primer formulation containing a primer backbone polymer and having a viscosity of between about 1100 cps and about 2500 cps at a temperature of 350° F., said primer backbone polymer including between about 30 and about 50% by weight of said primer of an ethylene-based polymer; and said hot-melt cover glue formulation contains a cover glue backbone polymer and has a viscosity greater than the viscosity of said primer formulation at a temperature of 350° F.

2. The book of claim 1, wherein said primer backbone polymer includes between about 35 and about 45% by weight of an EVA polymer, EVA acid terpolymer, ethylene ethyl acrylate polymer or ethylene acrylic acid polymer.

3. The book of claim 1, wherein said EVA polymer includes between about 18 and about 30% vinyl acetate, by weight.

4. The book of claim 1, wherein said cover glue backbone polymer includes polymers selected from the group consisting of EVA polymer, EVA acid terpolymer, ethylene ethyl acrylate polymer, SBS block copolymer, and SB multiblock polymer.

5. The book of claim 1, wherein said primer formulation includes one or more waxes in an amount between about 10 and about 20% by weight.

6. The book of claim 1, wherein said cover glue further includes one or more waxes in an amount between about 15 and about 25% by weight.

7. The book of claim 1, wherein said primer formulation further includes one or more tackifying resins in the amount of between about 25 and about 50% by weight.

8. The book of claim 7, wherein said tackifying resins include between about 3 and about 15% by weight of a phenolic modified terpene resin, between about 5 and about 25% by weight of a glycerol ester and between about 15 and about 30% by weight of a styrenated terpene or a hydrocarbon resin.

9. The book of claim 1, wherein said cover glue formulation further includes one or more tackifying resins in the amount of between about 20 and about 45% by weight.

* * * * *